US005937843A

United States Patent [19]

Troncoso

[11] Patent Number: 5,937,843

[45] Date of Patent: Aug. 17, 1999

[54] ARCHERY VIBRATION DAMPENING AND SHOCK DAMPENING DEVICE

[76] Inventor: Vincent F. Troncoso, 14090-6100 Rd., Montrose, Colo. 81401

[21] Appl. No.: 09/232,075

[22] Filed: Jan. 15, 1999

[51] Int. Cl.[6] ..... F41B 5/20

[52] U.S. Cl. ..... 124/89; 267/136

[58] Field of Search ..... 124/89; 267/136, 267/137, 140.12, 140.2

[56] References Cited

U.S. PATENT DOCUMENTS 3,757,761 9/1973 Izuta ..... 124/89 X 4,556,042 12/1985 Izuta ..... 124/89

*Primary Examiner*—John A. Ricci

*Attorney, Agent, or Firm*—Donald E. Nist

[57] ABSTRACT

The improved archery device has improved shock-absorbing and vibration-dampening properties. It includes an about circular ring and either of solid construction or is hollow with a fill port for liquids and/or particles which increase the inertial properties of the ring. The ring preferably is circular but can be oval and defines a central space in which is disposed at about the center thereof a disc which is preferably flat and circular and which includes a central opening to enable the device to be connected directly to an archery bow or to a stabilizer projecting outwardly from an archery bow. The ring and disc are connected to each other by a number of springs spaced preferably symmetrically along the periphery of the ring and disc. The spring can either be of metal with integral connectors at the opposite ends thereof or can be elastic bands with attached connectors at opposite ends thereof. Preferably the ring contains external grooves within which the connectors are seated. When the ring and disc are oval they are preferably aligned along their greater diameters.

8 Claims, 2 Drawing Sheets

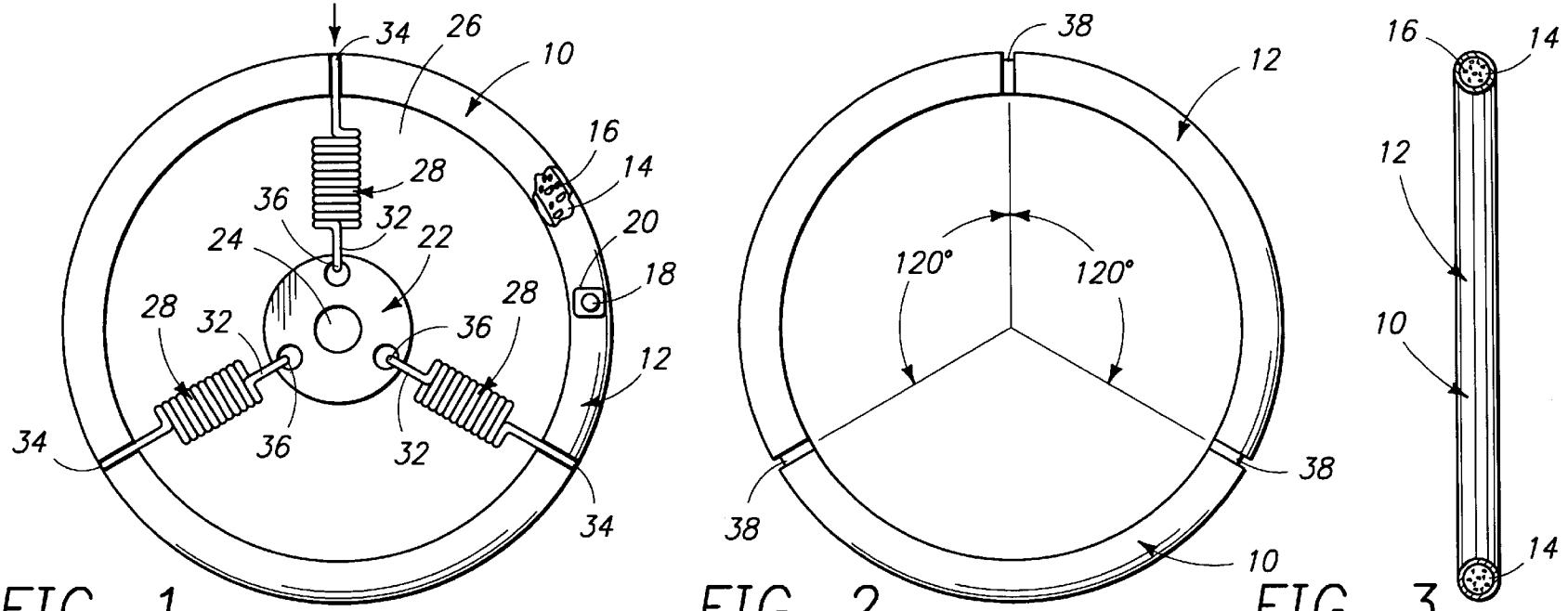
FIG. 1
FIG. 2
FIG. 3
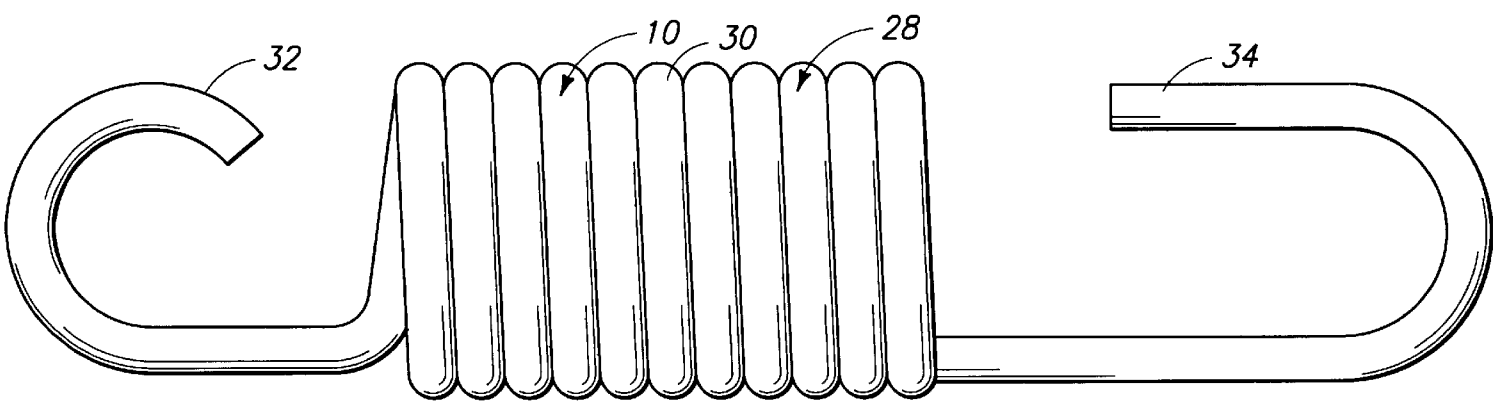
FIG. 4

ARCHERY VIBRATION DAMPENING AND SHOCK DAMPENING DEVICE

BACKGROUND OF THE INVENTION

Field of the Invention

The present invention generally relates to archery devices and more particularly to an improved archery device which dampens the shock and vibration which occur when an arrow is shot from an archery bow.

PRIOR ART

Various types of devices have been utilized to reduce the shock and vibrations occuring when an arrow is shot from an archery bow, whether that bow is a recurve bow or compound bow. Most such devices comprise elongated stabilizer arms with weighted outer ends, the arms being releasably connected to various portions of the bow riser, in some instances by connectors which contain elastomeric components.

However, such stabilizers are not totally effective. Parts connected to the bow such as sights and arrow rests tend to become misaligned or fall off of the bow during continued use of the bow, due to vibrations and shocks to the bow. In addition, such shocks and vibrations disturb the archer's aim and interfere with shooting accuracy.

Moreover, the elongated shape of the stabilizers requires them to be disconnected from the bow when the bow is stored and/or transported. In addition, they interfere with the archer's ability to pass through dense bush and the like during use of the bow for hunting purposes.

Accordingly, there is a need for an improved type of device which will substantially reduce the shock and vibrations occuring during shooting of an archery bow, and which will be compact and not interfere with an archer's use of the bow for hunting and other purposes. The device should be made small enough so that it can left in place connected to the bow during storage and transport of the bow.

Moreover, the device should be capable of being easily increased or decreased in weight, as desired, and should be inexpensive and durable, and easily installed, repaired and disconnected from the bow. The device should be effective to keep arrow rests and sights and other components properly aligned on the bow and prevent interference with the archer's aim and shooting accuracy.

SUMMARY OF THE PRESENT CLAIMED INVENTION

The improved archery device of the present invention satisfies all the foregoing needs. It can be easily attched to and disconnected from any desired location on an archery bow riser, is small, contains no large projections which would interfere with storage, use or transport of the bow and is adjustable easily to suit the needs of the archer. It can be made inexpensively in a variety of sizes and is durable and easily repaired.

The device includes an about round ring defining a central space within which a small disc is suspended, preferably symmetrically by a plurality of spaced spring means in the form of metallic springs with preferably integral connecters at opposite ends thereof, or elastomeric bands with connectors secured to opposite ends thereof.

Preferably, the ring has external grooves within which connectors at one end of the spring means are received while connectors at the opposite ends of the spring means are connected to spaced openings in the disc periphery. The disc also includes a central opening by means of which a bolt or the like can releasably secure the device to an archery bow riser or stabilizer for attachment to the bow. The disc and/or ring can be oval and if both are oval, they are preferably aligned along their greater diameters. However, the ring and disc are preferably circular.

The spring means are preferably symmetrically disposed in spaced relation along the entire periphery of the disc and ring. Moreover, the ring can be hollow with a reservoir or passageway along most of or the entire interior thereof for introducing a liquid or particulate solid thereinto to increase the weight and shock-absorbing and vibration-dampening properties of the device. In such instance, the ring also includes an entry port to the reservoir,with closure means such as an external removeable cap. The disc is preferably flat and the disc and ring preferably are of durable metal.

Various other features of the improved archery device of the present invention are set forth in the following detailed description and accompanying drawings.

DRAWINGS OF THE PREFERRED EMBODIMENTS

FIG. 1 is a schematic front elevation, partly broken away, of a first preferred embodiment of the improved archery device of the present invention;

FIG. 2 is a schematic front elevation of the ring of the device of FIG. 1;

FIG. 3 is a schematic vertical section through the ring of FIG. 2;

FIG. 4 is an enlarged schematic side elevation of one of the springs of the device of FIG. 1; and, FIG. 5 is a schematic front elevation, partly broken away, of a second preferred embodiment of the improved device of the present invention.

DETAILED DESCRIPTION OF THE PREFERRED EMBODIMENTS

Figure 5:
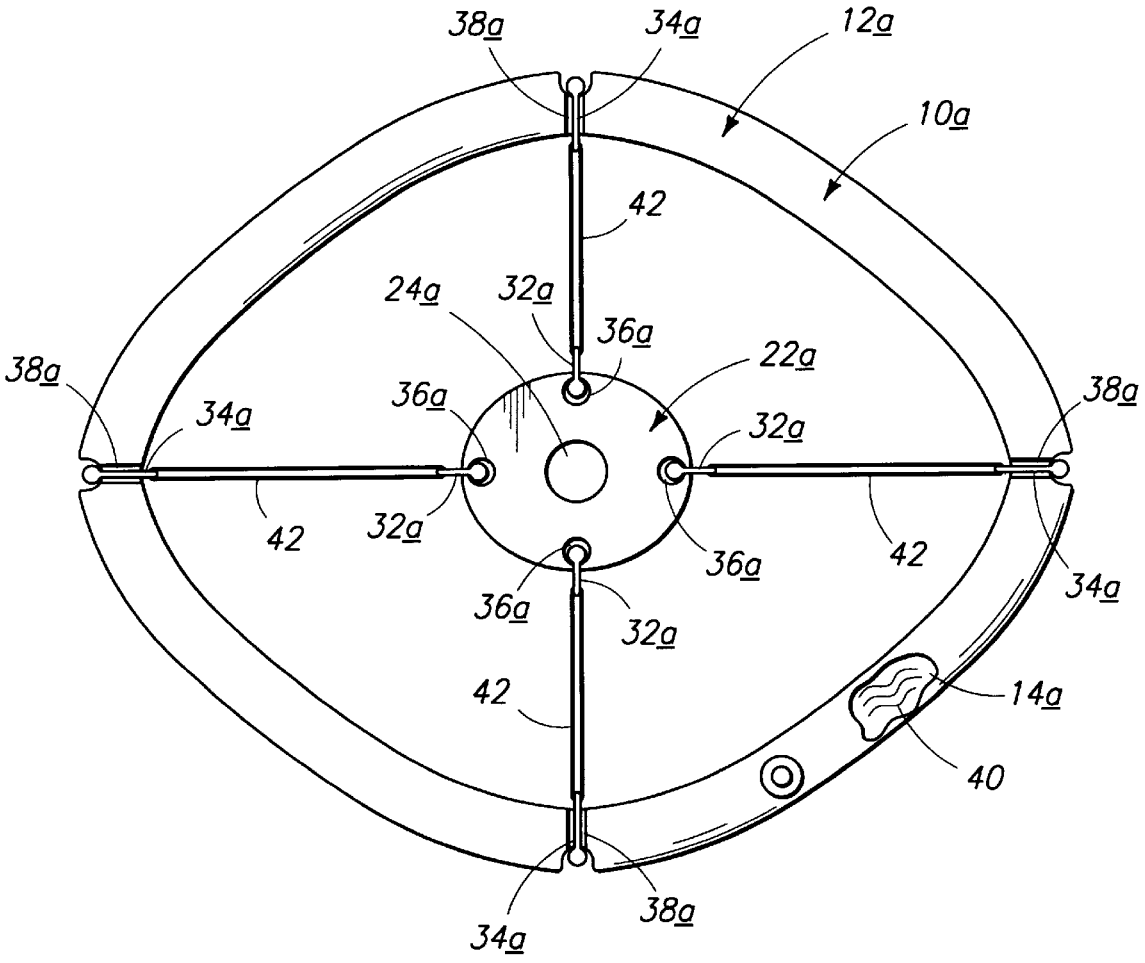

FIGS. 1–4:

Now referring more particulary to FIGS. 1–4 of the drawings, a first preferred embodiment of the improved archery device of the present invention is schematically depicted therein.

Thus, device 10 is shown, which comprises a hollow circular ring 12 with a central passageway or reservoir 14 extending therethrough and in which a body of solid particulate material 16, such as lead shot or the like, is shown disposed in passageway 14. Passageway 14 preferably extends throughout the length of ring 12 and access thereto is through a port 18 bearing a removeable closure cap 20 on the exterior of ring 12.

Device 10 also includes a circular flat disc 22 having a preferably central hole 24 therein for attachment of device 10 to the riser (not shown) of an archery bow or to a stabilizer (not shown) attached so such bow, by means of a screw or bolt or the like (not shown) passing through hole 24.

Disc 22 is suspended in a space 26 defined by ring 12, preferably with disc 22 centered in space 26. The means of suspension comprises springs 28, preferably metallic and each comprising a central coiled spring portion 30 integrally connected to connector hooks 32 and 34 on opposite ends thereof. Hook 32 is of smaller size than hook 34 and is designed to pass through an opening 36 in the periphery of disc 22 while larger hook 34 is seated in a depression or groove 38 in the outer surface of ring 12 and hooked around the outer periphery of ring 12.

In device 10 ring 12 has three equi-spaced grooves 38 disposed at 120 degrees from each other and aligned with three equi-spaced holes 36 in disc 22, and device 10 also has three springs 28, each spring 28 being connected to a separate disc hole 36 and ring groove 38, as shown in FIG. 1. With this array, ring 12 is free to exert a dampening effect on shocks and vibrations during shooting of an arrow from an archery bow to which device 10 is connected.

Preferably, both disc 22 and ring 12 comprise durable metal, such as steel, stainless steel, steel coated with a protective outer layer of a rust-resistant metal or metal alloy, copper, nickel, titanium, aluminum or the like.

Disc 22 may be thick or thin and of any suitable size, for example, about 1 inch in diameter with a central opening 24 having a diameter of about 5/16 of an inch, with ring 12 being about 3 and ¾ inches in outer diameter and about 3 inches in inner diameter so that the width of each portion of ring 12 is about ¼ inch. Other dimensions for ring 12 and disc 22 are also suitable.

Thus, ring 12 can be relatively smaller or larger than set forth herein, as can disc 22. Springs 28 are dimensioned so as to connect to ring 12 and disc 22, as previously described and preferably without appreciable slack.

The shock absorbing and vibration dampening effects achieved by the floating acion of ring 12, its spring suspension and its relative inertial quality which can be changed by changing the amount and type of particulate material 16, if any, disposed in passageway 14. Thus, an improved archery device with a smooth, snag-free outer surface and of relatively small size but with increased effectiveness is provided.

FIG. 5:

A second preferred embodiment of the improved archery device of the present invention is schematically set forth in FIG. 5. Thus, in FIG. 5 device 10*a* is shown. Components thereof similar to those of device 10 bear the same numerals but are succeeded by the letter "a".

Device 10*a* differs from device 10 only as follows:

a) device 10*a* has an oval ring 12*a* and an oval central disc 22*a;* b) passageway 14*a* is filled with a liquid 40 instead of particulate material 16; and, c) the springs employed in device 10*a* are four in number spaced at 90 degrees from each other, each being connected to a separate one of four disc 22*a* holes 36*a* and ring grooves 38*a* through a pair of connector hooks 32*a* and 34*a* secured to but not integral with elastomeric stretch bands 42 fabricated of elastic natural or synthetic rubber or plastic. Thus, bands 42 and hooks 32*a* and 34*a* function as the desired springs.

Device 10*a* preferably has oval disc 22*a* aligned with oval ring 12 along the axis of greater diameter of both, as shown in FIG. 5. Device 10*a* has substantially the advantages of device 10.

Various other modifications, changes, alterations and additions can be made in the improved archery device of the present invention, its components and parameters. All such modifications, changes, alterations and additions as are within the scope of the appended claims form part of the present invention.

What is claimed is:

1. An improved archery vibration dampening and shock dampening device, said device comprising, in combination:

a) an about round ring defining a central space;

b) a disc of smaller diameter than that of said ring, said disc including means for attaching said device to an archery bow; and, c) a plurality of spring means connected to said disc and to said ring at spaced intervals along the periphery of said ring and disc, suspending said disc at about the center of said space defined by said ring, said device, when connected to an archery bow, reducing the vibration and shock encountered by said bow during shooting of an arrow from said bow.

2. The improved archery device of claim 1 wherein said ring is hollow and includes a fill port with closure means for filling said ring with at least one of a) liquid and b) solid particles to increase the shock-absorbing and vibration-dampening property of said device.

3. The improved archery device of claim 1 wherein each of said spring means comprises one of a) an elastomeric band with connectors on opposite ends thereof, and b) a metallic spring with connectors on opposite ends thereof.

4. The improved archery device of claim 1 wherein said spring means are spaced symmetrically along the entire outer periphery of said ring and said disc.

5. The improved archery device of claim 4 wherein said disc is flat and circular and wherein said ring is circular and contains depressions holding the outer ends of said spring means.

6. The improved archery device of claim 1 wherein at least one of said ring and disc is oval.

7. The improved archery device of claim 6 wherein said ring and disc are oval, with the longer diameters thereof aligned with each other.

8. The improved archery device of claim 1 wherein said ring and disc comprise metal.

* * * * *